US006095623A

United States Patent [19]

Goto et al.

[11] Patent Number: 6,095,623

[45] Date of Patent: Aug. 1, 2000

[54] THREE PILLAR CONSTRUCTION STAND

[75] Inventors: Hirokazu Goto, San Diego; Shunsuke Hanaoka, Poway; Jared Lee Zamaloff, San Diego, all of Calif.

[73] Assignees: Sony Corporation, Tokyo, Japan; Sony Electronics, Inc., Park Ridge, N.J.

[21] Appl. No.: 09/190,381

[22] Filed: Nov. 10, 1998

[51] Int. Cl.[7] ..... A47B 5/00

[52] U.S. Cl. ..... 312/7.2; 312/223.3; 312/285; 312/265.6; 312/139.2

[58] Field of Search ..... 312/7.2, 138.1, 312/139.2, 204, 283, 285, 287, 289, 223.6, 109

[56] References Cited

U.S. PATENT DOCUMENTS

| | | | |
|---|---|---|---|
| 735,614 | 8/1903 | Stevens | 312/285 X |
| 2,753,236 | 7/1956 | Spring | 312/139.2 X |
| 3,761,152 | 9/1973 | Cory | 312/7.2 |
| 4,202,586 | 5/1980 | Oplinger | 312/265.6 X |
| 4,274,685 | 6/1981 | Bradshaw | 312/7.2 |
| 4,385,313 | 5/1983 | Slater et al. | 312/7.2 X |
| 5,176,435 | 1/1993 | Pipkens | 312/265.6 X |
| 5,216,211 | 6/1993 | Renk, Jr. | 312/7.2 X |
| 5,584,595 | 12/1996 | Gantitano et al. | 312/7.2 X |
| 5,782,544 | 7/1998 | Johnson, Sr. | 312/7.2 |
| 5,961,192 | 10/1999 | Bernart et al. | 312/223.3 |

*Primary Examiner*—Peter M. Cuomo
*Assistant Examiner*—Stephen Vu
*Attorney, Agent, or Firm*—Blakely, Sokoloff, Taylor & Zafman LLP

[57] ABSTRACT

An improved cabinet for supporting a television and supporting electronics. In one embodiment, the cabinet uses three pillars to support the television unit. Shelves positioned between the three pillars support video source components. Removable side panels facilitate access to cables used to couple the television unit to the video source components.

15 Claims, 5 Drawing Sheets

THREE PILLAR CONSTRUCTION STAND

BACKGROUND OF THE INVENTION

1. Field of the Invention

The present invention relates to a cabinet to support a display unit. In particular, the invention describes a method and apparatus for a television stand to support a television unit.

2. Description of Related Art

Over the last few years, television sets and the source devices which provide a signal to the television set have become increasingly more complicated. The complexity of television units has further dramatically increased with the introduction of high definition television (HDTV). HD television requires that a television unit handle a wide variety of signals including analog signals such as standard National Television Standards Committee (NTSC) signals broadcast by television networks and provided by source devices such as video cassette recorders (VCRs), laser disk (LD) players and the like. Unlike traditional analog television units, HD television units also handle digital signals output by select broadcasters on selected programs and future digital source devices. In order to house the complex electronics used to handle the increasing variety of data types, new HD television units locate some of the electronics that are housed in the television cabinet in a separate box outside the television unit. Standard television cabinets do not provide convenient storage of such externally located electronics, nor do these cabinets facilitate the connection of these receiving units with conventional sources such as video cassette recorders, LD players, and DVD players.

Traditionally, a television set was placed on top of a cabinet or television stand. The television stand may include a front door that opens to allow insertion of source devices such as DVDs, LD players, and VCRs. In order to reach wiring used to interconnect components such as source devices and the television unit, components often were removed from the television stand by opening the doors and pulling the components out of the front of the television stand. Once removed, connectors such as RCA connectors are connected before returning the components to the cabinet. Such removal and installation of components is inconvenient. Removal and insertion of a component also required cables that are longer than necessary. Longer cables are needed to allow for movement of the components in and out of the front of the cabinet. Extra cable length contributes to cost and also results in deterioration of the signal due to parasitic capacitance and resistances inherent in a longer cable. Longer cables are also susceptible to electromagnetic interference. Thus, an improved method for connecting components which provide a signal to a television unit is needed.

A second disadvantage of traditional display stands is that traditional display stands required four support structures. Typically, the four-support structures or four-support pillars were used to support the four corners of an approximately rectangular surface used to support a television set. One disadvantage of using four load bearing structures is that using four support pillars increases the cost and the materials needed to fabricate the cabinet. A second disadvantage of using four support structures is that a four-support structure configuration typically utilizes an approximately rectangular top surface which does not match the almost triangular top shape of a traditional cathode ray tube (CRT) television unit. A television unit typically has a CRT which increases in size as one moves towards the screen area.

A third disadvantage of traditional television stands is that such stands do not usually accommodate an external HD television receiver or set back box.

Thus, an improved television stand is needed.

SUMMARY OF THE INVENTION

The present invention describes an improved television stand. In one embodiment, the improved television stand supports a HD television unit and a set back box. In an embodiment of the present invention, the television set is supported by three load bearing pillars. In still a second embodiment of the invention, removable sidewalls on the television stand allow easy installation of components including the HD television set back box. In a third embodiment of the invention, a cover may cover the HD television set back box to prevent dirt and other particles from reaching the set back box.

BRIEF DESCRIPTION OF THE DRAWINGS

The advantages of the invention will become more readily apparent to those ordinarily skilled in the art after reviewing the following detailed description and accompanying drawings wherein.

DETAILED DESCRIPTION

The present invention relates to a television stand to support a television unit such as a HD television unit. In one embodiment of the invention, the television stand has three support pillars which support a television unit. The television stand may also, in one embodiment of the invention, have removable sidewalls or side panels to facilitate coupling a cable to the back of components coupled to the television unit. The television stand may also include a compartment specially designed for a HD television "set back box" to receive high definition television signals or to convert analog signals into a digital high definition television signal.

In the following description, various embodiments of a television stand will be described. For example, the materials used in the construction of the television stand, the dimensions of the television stand, the fastening techniques used to fasten sidewalls to support structures, and other details will be included. However, such details are included to facilitate understanding of the invention and to describe alternative embodiments for implementing the invention. Such details should not be used to limit the invention to the particular embodiments described because other variations which would be obvious to one of ordinary skill in the art are possible while staying within the scope of the invention.

Figure 1:
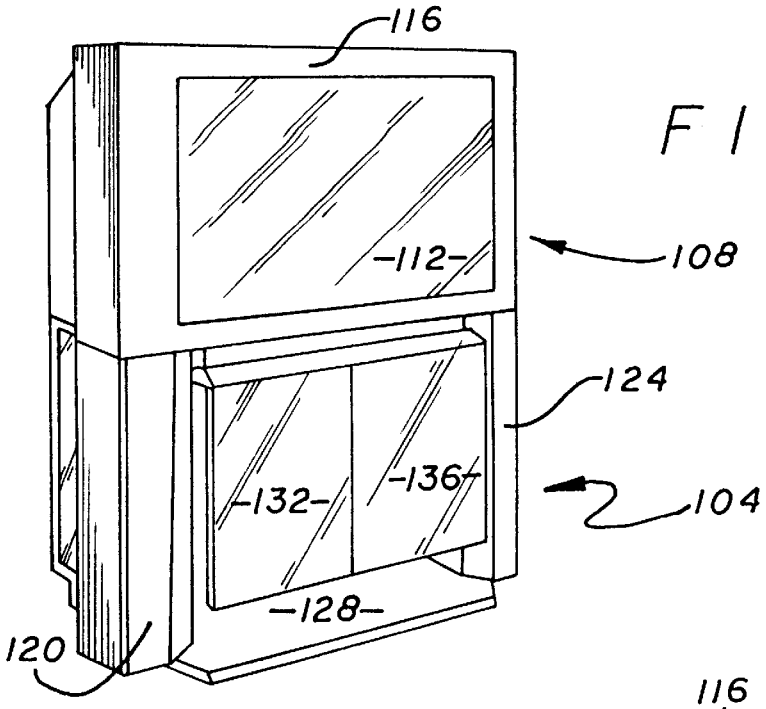
FIG. 1 illustrates one embodiment of the television stand of the present invention as used to support a HD television unit.

FIG. 1 illustrates a television stand 104 includes a television unit 108 mounted on top. Television set 108 includes a viewing surface such as a screen 112 which in one embodiment is a cathode ray tube (CRT) screen in which moving images are displayed using an electron beam which strikes phosphorous particles on screen 112. Screen 112 typically ranges from 27 inches diagonally to about 40 inches diagonally and is mounted into a frame 116. Television units 108 may be very heavy, typically on the order of 50 pounds to approximately 200 pounds. Front pillars 120, 124 of television stand 104 support the load from the front half of television set 108. Front pillars 120, 124 are coupled together near the floor by a base 128 and at the top by a top surface (not shown in FIG. 1). Two doors 132, 136 typically remain closed but can be opened to allow user access to components stored behind doors 132, 136. Such components may include source devices such as LD players, DVD players, VCRs to provide video signals for television unit 108. In one embodiment of the system, the television unit 108 may be a HD television and the electronics stored behind doors 132, 136 may include a set back box, to convert received signals to a format usable by HD television unit 108.

Figure 2:
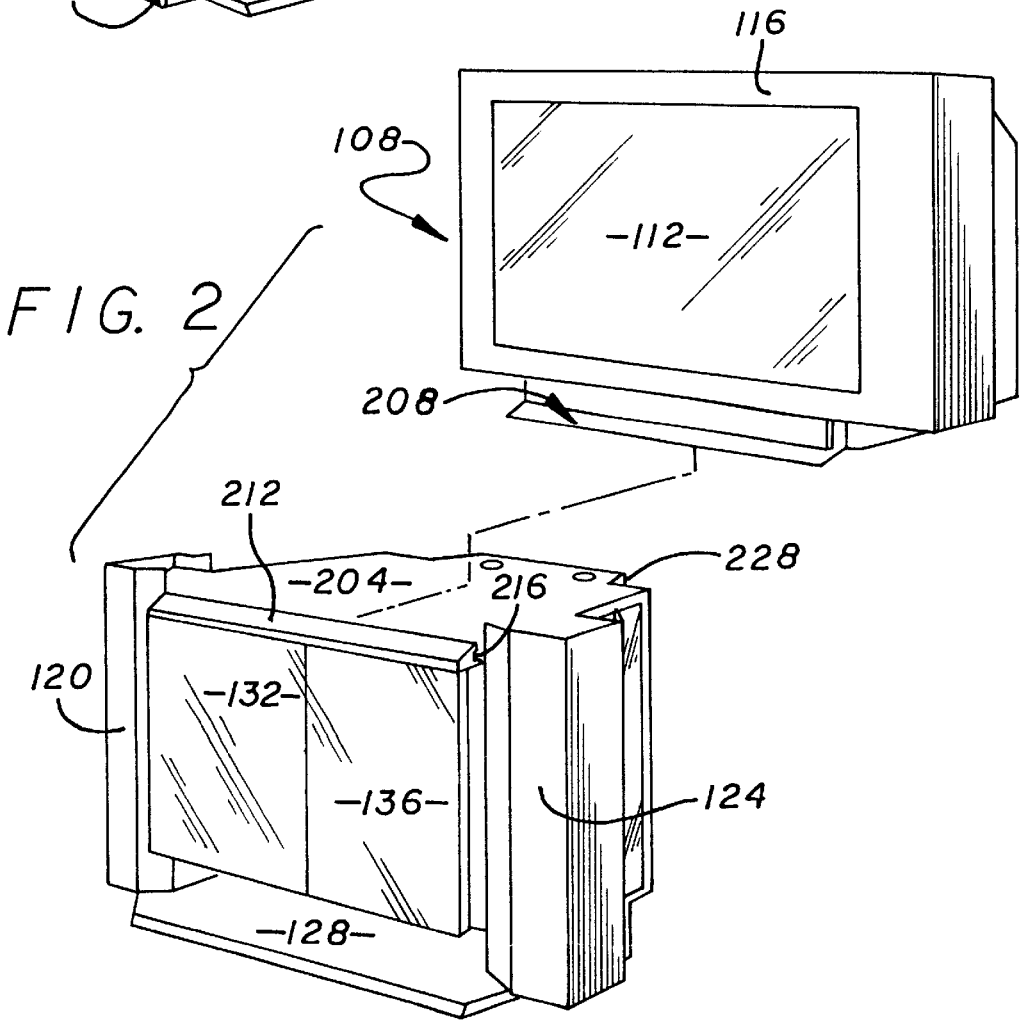
FIG. 2 is an embodiment of the invention showing the installation of the television unit on the television stand.

FIG. 2 illustrates how the television unit 108 may be attached and detached from television stand 104. In one embodiment of the invention, a top surface 204 of television stand 104 supports the bottom of television unit 108. A flange or extension 208 of the television unit 108 extends forward to fit underneath a cover 212 in the front of television stand 104. Sliding extension 208 into groove 216 in cover 212 conceals the joint between television unit 108 and television stand 104. The sliding extension 208 also provides an aesthetically pleasing frontal view of the television stand 104 and television unit 108 as a single integrated unit. Thus, a top surface of stand 104 and a base of television unit have similar dimensions. In one embodiment the television stand 104 is approximately three feet high, about four to five feet across and about two feet deep. Cover 212 also assists in securing and positioning television 108 to prevent shifting of the television across top surface 204.

Figure 3:
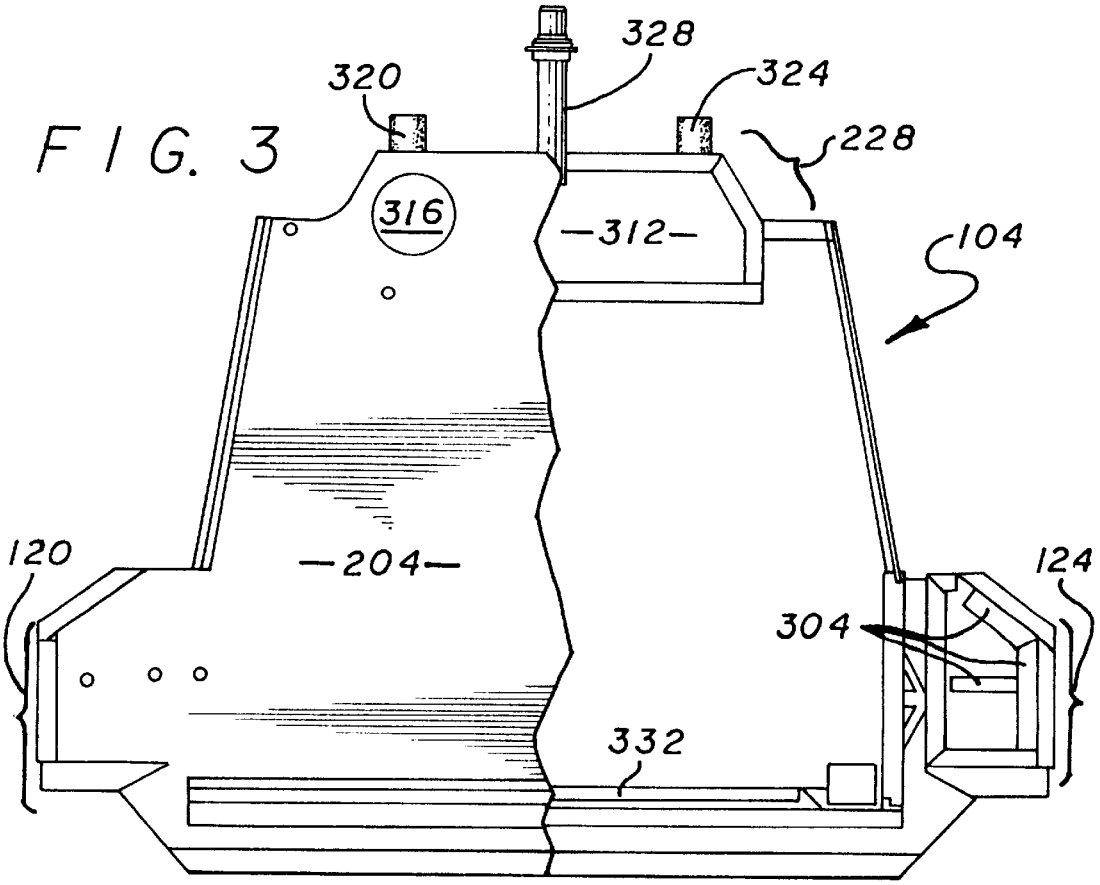
FIG. 3 illustrates a top view of the television stand to show the three pillars which bear the load of the television unit.

FIG. 3 illustrates a partial cut-away view of the top of television stand 104. Three pillars 120, 124, 228 support top surface 204. Two front pillars 120, 124 positioned at the front of television stand 104, the front defined as the half of the television stand which supports the image portion of television unit 108, and a single pillar 228 positioned at the rear of television stand 104, together bear the load of television unit 108. Each pillar 120, 124, 228 is designed to support significant weight, as a television unit may typically weigh in excess of 100 pounds. Thus, structural supports 304 positioned inside the pillar reinforce pillar 120. Front pillars 120, 124 typically support significant weight because a greater percentage of the load of television unit 108 is towards the front of the television unit. Rear pillar 228 supports the entire load of a back end of the television unit 108.

In one embodiment of the invention, rear pillar 228 includes hollow chamber 312. Hollow chamber 312 routes wires and other cables from components within television stand 104 through an opening 316 to couple to the rear of television unit 108. By hollowing out rear pillar 228, television stand 104 neatly stores the cables which connect components to television unit 108 of FIG. 1. Rubber bumpers 320, 324 prevent the movement of television stand 104 against a wall and crushing cables which extend from the back of television stand 104. Strap 328 may be secured to a television unit 108 to secure television unit 108 to television stand 104. Typically, each pillar 120, 124, 228 is composed of wood such as particle board or multi-dense fiber (MDF) board although other construction materials may be used.

In the illustrated embodiment, the front of television stand 104 includes a rail 332 used to open and close doors 132, 136. Various embodiments of opening and closing doors 132, 136 of FIG. 1 may be used, including installation of hinges to allow outward movement of doors 132, 136. In an alternate embodiment, doors 132, 136 slide open along a direction parallel to the screen 112 surface of television unit 108.

Figure 4:
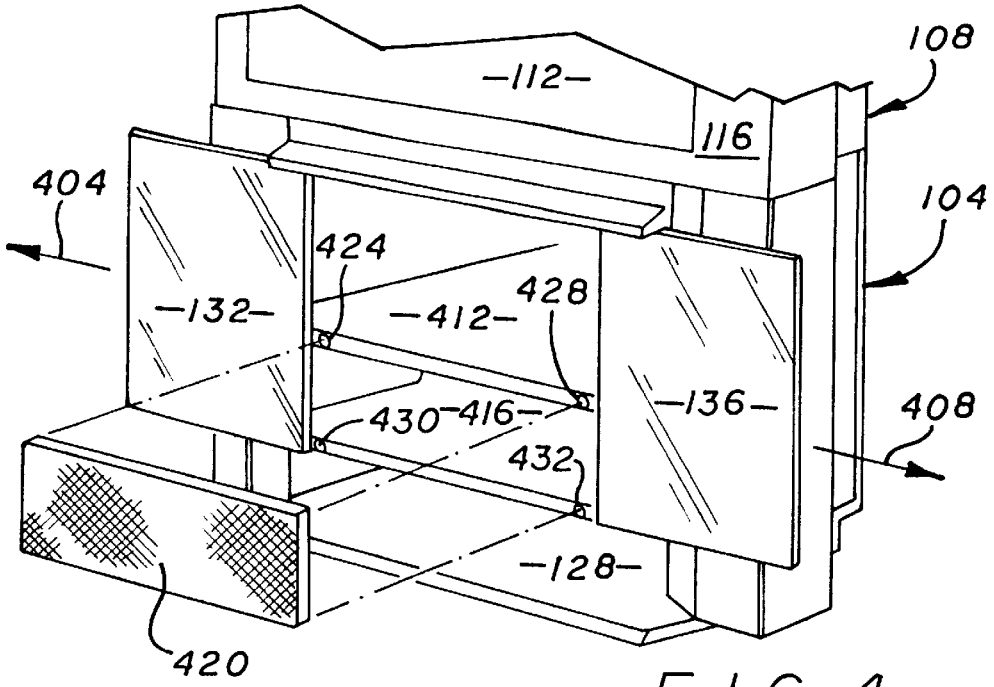
FIG. 4 illustrates a front view of the television stand in one embodiment of the present invention with the removable cover which protects the set back box for the HD television unit.

FIG. 4 illustrates an interior view of television stand 104 when doors 132, 136 are open. In the illustrated embodiment of FIG. 4, doors 132, 136 open in the direction of arrows 404, 408. Doors 132, 136 slide along a rail underneath cover 212. The construction of the rail is described in a co-pending patent application entitled FRAMELESS SLIDING DOOR SYSTEM FOR A TELEVISION CABINET STAND, filed on Nov. 10, 1998, and assigned to the same assignee, which is hereby incorporated by reference.

Inside television stand 104 are two shelves including a top shelf 412 and bottom shelf 416. In one embodiment of the invention, top shelf 412 is used to support components, particularly source components, such as VCRs, LD players, DVD players and the like. Bottom shelf 416 supports a set back box. The set back box typically includes reception circuitry and other processing circuitry used to process digital signals for display by television unit 104. Bottom shelf 416 may include indentations and other artifacts customized to secure the set back box to bottom shelf 416.

Because set back box typically does not contain controls which a user regularly needs to access, the set back box may be concealed behind a cover panel such as grill 420. The cover panel, such as grill 420 may be a piece of wood, a mesh screen or other opaque media. Fasteners 424, 428, 432, 436 affix grill 420 to top shelf 412 and bottom shelf 416. In one embodiment of the invention, the fasteners 424, 428, 432, 436 are dual lock fasteners used to hold grill 420 across the opening between top shelf 412 and bottom shelf 416. In an alternate embodiment, the fasteners may be implemented using mushroom-shaped pegs which fit into holes in top shelf 412 and bottom shelf 416 similar to the structure used to hold speaker grills to a speaker box. The cover panel such as grill 420 prevents dust and dirt particles from reaching set back box and provides an attractive uncluttered appearance when doors 132, 136 are open. Grill 420 is removable to facilitate changes in the set back box. The set back box typically is changed when technological advances render a particular set back box obsolete. For example, when a new method of processing digital signals is needed, the set back box is easily replaced.

Figure 5:
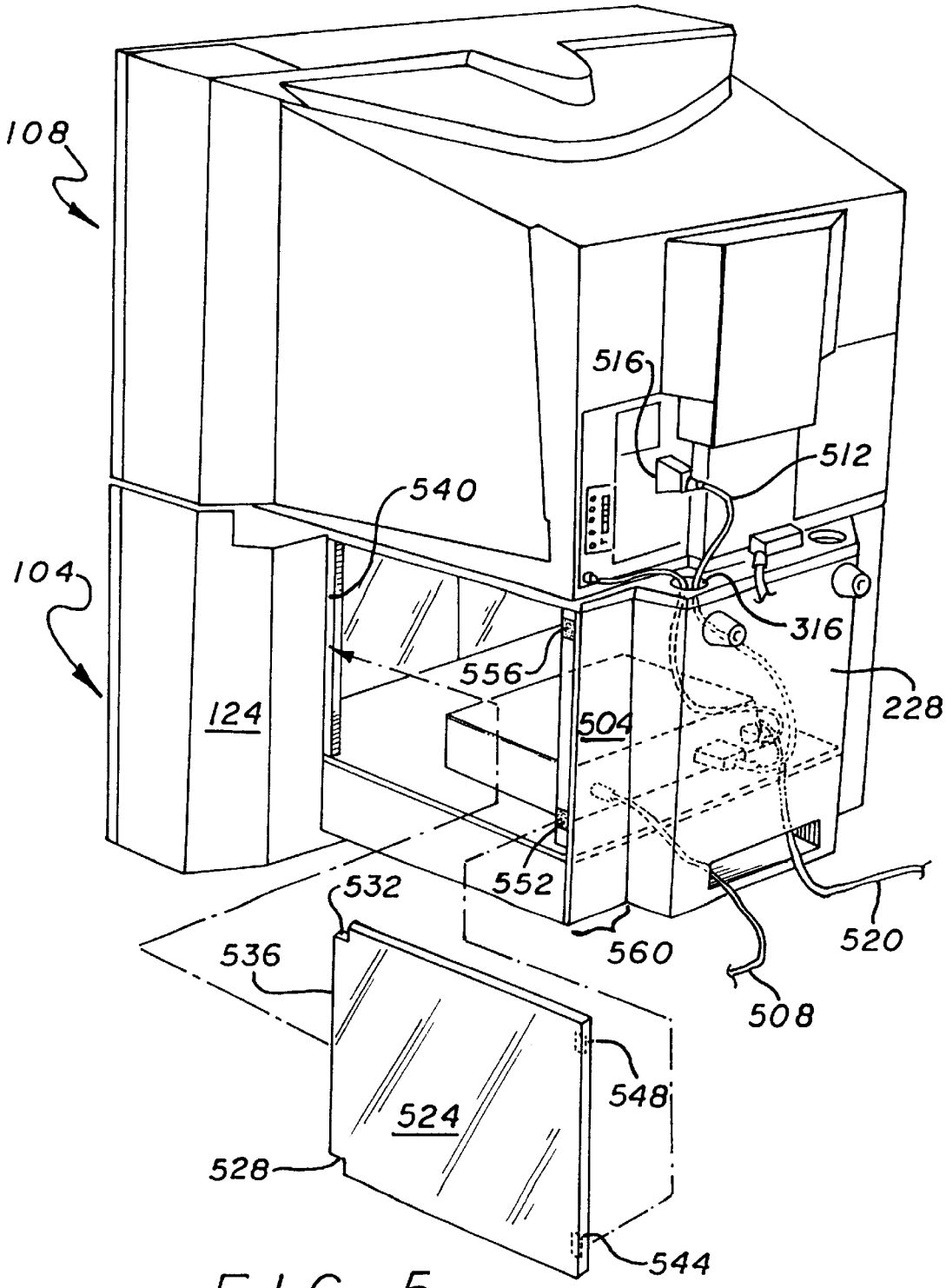
FIG. 5 illustrates a side view of the television set illustrating use of the removable sidewalls.

FIG. 5 illustrates a rear view of television unit 108 and television stand 104 including interconnect cables connecting television unit 108 and a set back box 504. In the illustrated embodiment, a cable 508 carries signals from an antenna (not shown) to set back box 504 which processes the NTSC or digital signal. The set back box 504 outputs a video signal along cable 512. Cable 512 is routed through the hollow portion of back pillar 228 to input 516 of television unit 108. In one embodiment of the invention, control signals from set back box 504 may also be multiplexed onto cable 512. Power line 520 supplies power to television unit 108 through the hollow chamber of rear pillar 228.

FIG. 5 illustrates removable sidewall panels 524 in one embodiment of the present invention. A removable sidewall facilitates placement of set back box 504 on bottom shelf 416 as well as other components on top shelf 412. Removable sidewall panels 524 allows a user to insert a hand behind components including set back box 504 without removing the other components from their position inside television stand 104. Because components do not have to be removed from television stand 104 to attach interconnect cables such as cable 512, cable 512 is cut to a short length needed to couple television unit 108 to set back box 504. Cable 512 runs from the back of set back box 504, through hollow chamber 312 of pillar 228. An opposite end of cable 512 exits hollow chamber 312 through hole 316 to couple to an input 516 of television unit 108.

A variety of techniques may be used to attach and remove sidewall 524 to the side of television stand 104. In one embodiment of the invention, side panel 524 has notched ends 528, 532 on either end of a track edge 536. The track edge 536 of side panel 524 fits into a groove 540 cut into the back of one of the front pillars (e.g., front pillar 124). An opposite edge of side panel 524 includes fasteners 544, 548 which mate or couple to opposite fasteners 552, 556. In one embodiment of the invention, the fasteners 544, 548 are loops of dual lock which matches to corresponding dual lock felt pieces 552, 556. Other methods of fastening may also be obvious to one of ordinary skill in the art.

Because the entire load of television unit 108 is supported by three pillars 120, 124, 228, sidewall 524 does not need to support weight and may be fabricated of lightweight material such as an acrylic panel. The use of lightweight materials eliminates the need for strong fasteners. Thus, one embodiment of the invention utilizes a light removable panel as a removable sidewall panels 524. One end of removable sidewall 524 couples to front pillar 124. An opposite end of removable sidewall 524 couples to extension section 560 which is attached to pillar 228.

Figure 6:
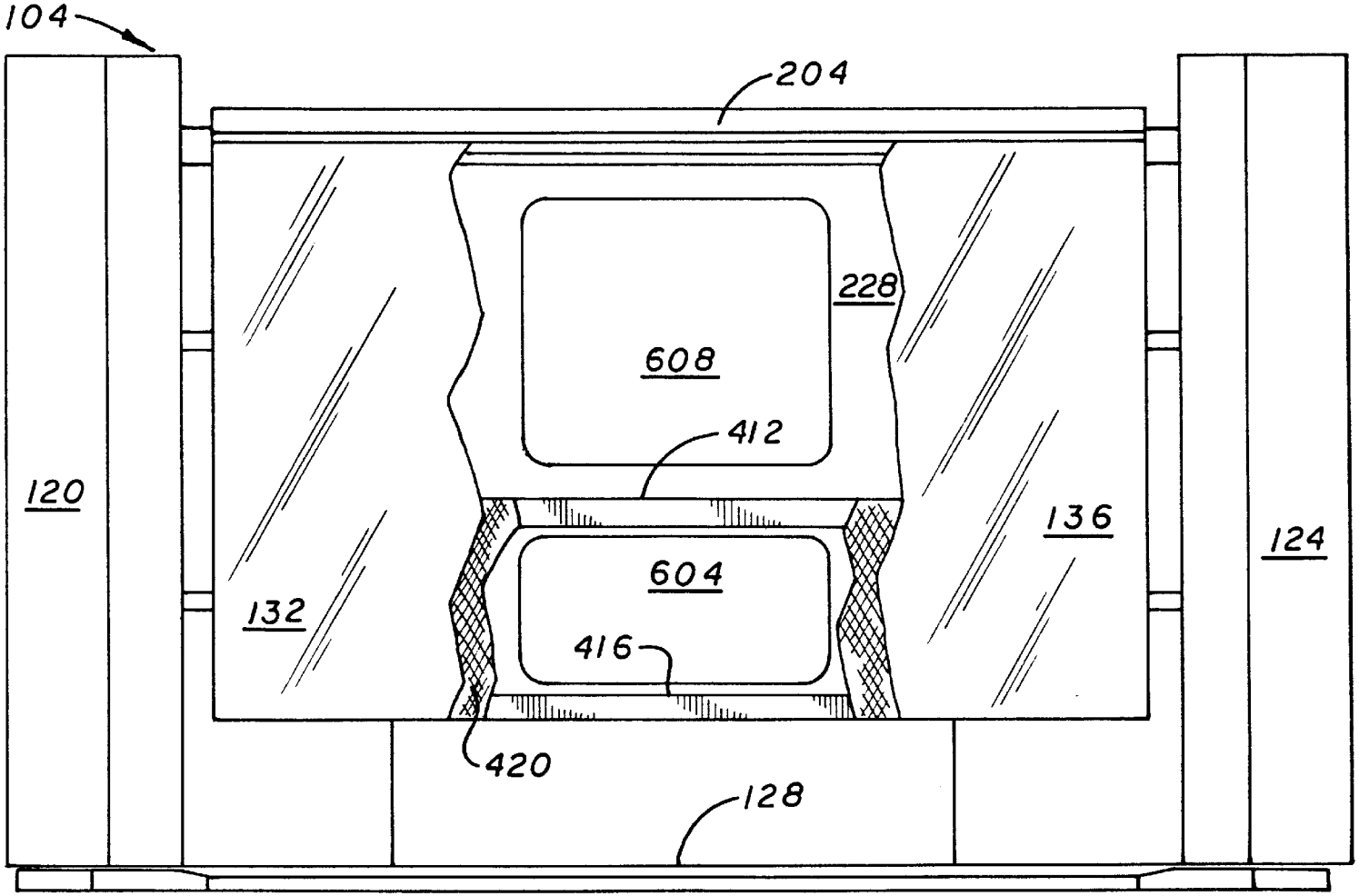
FIG. 6 illustrates a view of a back wall of the television stand in one embodiment of the present invention.

FIG. 6 illustrates an interior view of television stand 104 with part of front doors 132, 136 cut away. Front pillars 120, 124 support lower shelf 416, top shelf 412 and top surface 204. Base 128 couples the bottom of pillars 120, 124. Cut outs 604, 608 facilitate easy insertion of cables into the hollow chamber 312 of rear pillar 228. Thus, cables from components enter the hollow chamber 312 through cut outs 604, 608 in the rear chamber.

Figure 7:
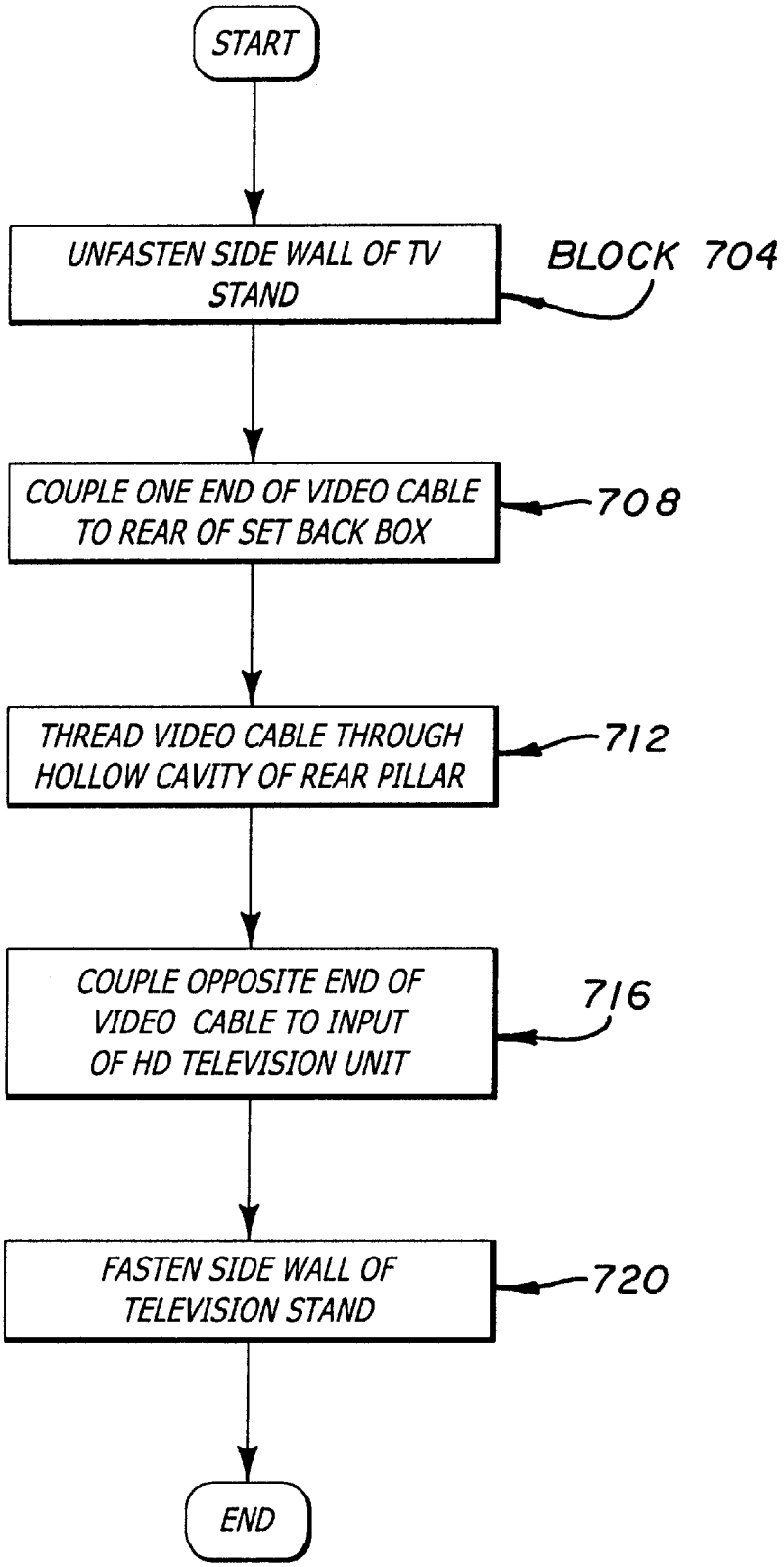
FIG. 7 is a flow diagram illustrating the installation of a set back box inside the television stand.

FIG. 7 is a flow diagram illustrating the simplicity of installing a set back box in one embodiment of the television stand 104 of the present invention. In block 704, the fasteners holding a sidewall to the television stand is disengaged in block 704. One end of a video cable is coupled to the rear of the set back box in block 708. In order to connect a video cable to the rear of a set back box, it is observed that the set back box does not need to be removed from the inside of television stand 104. The video cable is threaded through the hollow cavity of the rear pillar in block 712.

In block 716, an opposite end of the video cable may be coupled to the input of a HD television unit sitting on top of the television stand. After coupling video cable from the set back box to the television unit, and connecting other cables which may be needed to connect components such as source devices to the HD television unit, and connecting power cables providing power to the HD television unit to the sidewall may be reattached to the television stand. In one embodiment of the invention, reattachment of the sidewall includes the operation of inserting the sidewall into a groove and rotating the sidewall to engage dual lock fasteners thereby closing a side of television stand 104 in block 720.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A cabinet to support a television unit, the cabinet comprising:

a base;

a top surface;

a first pillar and a second pillar to support a front end of the television unit, the first pillar coupling a first front corner of the base to a first front corner of the top surface and the second pillar to couple a second front corner of the base to a second front corner of the top surface;

plurality of removable side walls wherein each of the removable side walls is made of acrylic; and a third rear pillar to bear the entire load of a back end of the television unit, the third pillar coupling the top surface to the base.

2. The cabinet of claim 1 wherein the third rear pillar is hollow to allow cords from the television unit to couple to source devices placed inside the cabinet.

3. The cabinet of claim 1 wherein the side walls are removable to facilitate placement of objects under the top surface.

4. The cabinet of claim 3 wherein a first sidewall of the plurality of removable sidewalls couples to the first pillar and a second sidewall of the plurality of removable sidewalls couples to the second pillar, each removable sidewall coupled to opposite sides of the third pillar.

5. The cabinet of claim 1 further comprising:

a shelf between the three pillars, the shelf to support a set back box to provide high definition television signals to the television unit.

6. The cabinet of claim 5 further comprising:

a cover to couple to the shelf and conceal the set back box when a door coupled to the first pillar is open.

7. A cabinet to store components, the components providing a video signal, the cabinet comprising:

a frame of pillars;

doors coupled to the frame; and removable side panels adjacent to and oriented approximately perpendicular to the doors, wherein at least one of the removable side panels is made of acrylic.

8. The cabinet of claim 7 wherein the removable side panels are coupled to the frame of pillars by dual lock fasteners.

9. The cabinet of claim 7 wherein the frame of pillars consists of exactly three pillars.

10. The cabinet of claim 7 further comprising a cover installed behind the doors to conceal a set back box for providing high definition digital television signals for a high definition television unit.

11. The cabinet of claim 7 wherein a first end of the removable side panels couples to a groove and a second end of the removable side panels couples to a fastener.

12. The cabinet of claim 7 wherein each of the removable side panels is made of acrylic.

13. A system for receiving video images comprising:

a television unit;

three pillars to support a top surface and the television unit;

a shelf supported by the three pillars, the shelf to support a video source component;

a door coupled to at least one pillar of the three pillars, the door openable to allow access to controls of the video source component; and a removable side panel coupled to at least one pillar of the three pillars such that removal of the removable side panel enables access to wires behind the video source component, wherein the removable side panel is made of acrylic.

14. The system of claim 13 wherein the video source component is a set back box to provide high definition digital television signals to the television unit.

15. The system of claim 14 further comprising:

a cover coupled to the shelf, the cover to conceal the set back box when the door is open.

* * * * *